US008959807B2

(12) United States Patent
LaHood et al.

(10) Patent No.: US 8,959,807 B2
(45) Date of Patent: Feb. 24, 2015

(54) EDGE PROTECTOR FOR GROUND ENGAGING TOOL ASSEMBLY

(71) Applicant: Caterpillar Inc., Peoria, IL (US)

(72) Inventors: James Robert LaHood, Peoria, IL (US); Murray A. Smith, Oro-Medonte (CA); Craig Harder, Edmonton (CA)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 13/706,681

(22) Filed: Dec. 6, 2012

(65) Prior Publication Data

US 2013/0145659 A1 Jun. 13, 2013

Related U.S. Application Data

(60) Provisional application No. 61/570,223, filed on Dec. 13, 2011.

(51) Int. Cl.
*E02F 9/28* (2006.01)
*E02F 3/815* (2006.01)

(52) U.S. Cl.
CPC ..... *E02F 9/2883* (2013.01); *E02F 3/8152* (2013.01); *E02F 9/2833* (2013.01)
USPC ..... 37/455; 37/456

(58) Field of Classification Search
USPC ..... 37/448–459; 172/701.2, 701.3, 772, 172/772.5
See application file for complete search history.

(56) References Cited

U.S. PATENT DOCUMENTS

| | | | | |
|---|---|---|---|---|
| 1,959,847 | A * | 5/1934 | Van Buskirk | 37/450 |
| 2,005,016 | A * | 6/1935 | Van Buskirk | 37/452 |
| 5,016,365 | A * | 5/1991 | Robinson | 37/451 |
| 5,088,214 | A * | 2/1992 | Jones | 37/450 |
| 5,469,648 | A * | 11/1995 | Jones et al. | 37/457 |
| 5,553,409 | A | 9/1996 | Irving | |
| 5,913,605 | A | 6/1999 | Jusselin et al. | |
| 6,848,203 | B2 * | 2/2005 | Hohmann et al. | 37/446 |
| 7,219,454 | B2 * | 5/2007 | Maher | 37/456 |
| 7,536,811 | B2 * | 5/2009 | McClanahan | 37/455 |
| 7,690,137 | B2 * | 4/2010 | Pasqualini | 37/455 |
| 7,793,444 | B2 * | 9/2010 | Jones et al. | 37/456 |
| 8,074,383 | B2 * | 12/2011 | McClanahan | 37/455 |
| 8,122,623 | B1 | 2/2012 | Hughes | |
| 2004/0098886 | A1 * | 5/2004 | Hohmann et al. | 37/451 |

(Continued)

FOREIGN PATENT DOCUMENTS

| | | |
|---|---|---|
| FR | 2596785 | 10/1987 |
| GB | 1215839 | 12/1970 |

(Continued)

*Primary Examiner* — Matthew D Troutman

(74) *Attorney, Agent, or Firm* — Finnegan, Henderson, Farabow, Garrett & Dunner, LLP

(57) ABSTRACT

An edge protector for mounting to a lip of a ground engaging tool and shielding an edge of the lip is disclosed. The edge protector may include a tip configured to extend forward from the edge of the lip of the ground engaging tool. The edge protector may also include a first mounting leg extending rearward from the tip. Additionally, the edge protector may include a second mounting leg extending rearward from the tip and spaced from the first mounting leg by a recess configured to receive the lip of the ground engaging tool between the first mounting leg and the second mounting leg. The first mounting leg may include a lock cavity configured to house a lock in such a manner that the lock is sandwiched between the first mounting leg and the lip of the ground engaging tool.

14 Claims, 12 Drawing Sheets

(56) References Cited

U.S. PATENT DOCUMENTS

| | | | | |
|---|---|---|---|---|
| 2004/0216335 | A1* | 11/2004 | Jones | 37/453 |
| 2004/0244236 | A1* | 12/2004 | Mautino | 37/456 |
| 2006/0037219 | A1* | 2/2006 | Robinson et al. | 37/456 |
| 2007/0022640 | A1* | 2/2007 | Jones et al. | 37/452 |
| 2008/0092413 | A1* | 4/2008 | McClanahan et al. | 37/451 |
| 2008/0148608 | A1* | 6/2008 | Harder et al. | 37/455 |
| 2008/0184603 | A1* | 8/2008 | Pasqualini | 37/459 |
| 2010/0162594 | A1 | 7/2010 | Bierwith | |
| 2011/0035970 | A1 | 2/2011 | Smith et al. | |

FOREIGN PATENT DOCUMENTS

| | | |
|---|---|---|
| WO | 2007016719 | 2/2007 |
| WO | 2008021376 | 2/2008 |

* cited by examiner

EDGE PROTECTOR FOR GROUND ENGAGING TOOL ASSEMBLY

RELATED APPLICATIONS

This application is based on and claims the benefit of priority from U.S. Provisional Application No. 61/570,223, filed Dec. 13, 2011, the contents of which are expressly incorporated herein by reference.

TECHNICAL FIELD

The present disclosure relates to ground engaging tools, and more particularly, to protecting edges of ground engaging tools.

BACKGROUND

Many machines include ground engaging tools for performing tasks like digging, tilling, ripping, loading, and/or other excavation tasks and the like. Such ground engaging tools often include one or more lips with edges on them. For example, excavating buckets often include lips with edges on them. If such lips are left unprotected, contact with soil, rock, and other materials may damage or wear the edges of the lips. Repairing or replacing the lip of such a ground engaging tool due to wear or damage of the edge may involve significant expense. Accordingly, many ground engaging tools include removable edge protectors mounted to their lips to shield the edge of the lip from contact with soil, rock and other materials.

For example, Published U.S. Patent Application No. 2010/0162594 to Bierwith ("the '594 application") discloses a power driven shovel with a shroud attached to its lip. The shroud of the '594 application includes an aperture that aligns with an aperture in a forward portion of the lip on the power driven shovel. A nut fits in the aperture in the forward portion of the lip, and a screw extends through the aperture in the shroud into the nut to secure the shroud to the lip.

Although the '594 application discloses a shroud mounted to a forward edge of a lip on a power driven shovel, certain disadvantages may persist. For example, the configuration of the provisions used to secure the shroud to the forward portion of the lip may be conducive to losing some of the retention hardware. Specifically, if the screw used to secure the shroud to the lip works loose, it could separate from the power driven shovel and get lost.

The disclosed system may help solve one or more of the foregoing problems.

SUMMARY

One disclosed embodiment relates to an edge protector for mounting to a lip of a ground engaging tool and shielding an edge of the lip. The edge protector may include a tip configured to extend forward from the edge of the lip of the ground engaging tool. The edge protector may also include a first mounting leg extending rearward from the tip. Additionally, the edge protector may include a second mounting leg extending rearward from the tip and spaced from the first mounting leg by a recess configured to receive the lip of the ground engaging tool between the first mounting leg and the second mounting leg. The first mounting leg may include a lock cavity configured to house a lock in such a manner that the lock is sandwiched between the first mounting leg and the lip of the ground engaging tool.

The disclosure further relates to an edge protector for mounting to a lip of a ground engaging tool and shielding an edge of the lip. The edge protector may include a tip configured to extend forward from the edge. The edge protector may also include a first mounting leg extending rearward from the tip. The first mounting leg may include a lock bulge extending outward from an outer surface of the second mounting leg and a lock cavity configured to receive a lock inward of the lock bulge.

The disclosure also relates to a ground engaging tool assembly. The ground engaging tool assembly may include a lip of a ground engaging tool, the lip having an edge. The ground engaging tool assembly may also include an edge protector mounted to the lip. The edge protector may include a dip extending forward of the edge. The edge protector may also include a first mounting leg extending rearward from the tip adjacent a first side of the lip. Additionally, the edge protector may include a second mounting leg extending rearward from the tip and spaced from the first mounting leg by a recess configured to receive the lip of the ground engaging tool between the first mounting leg and the second mounting leg. The second mounting leg may include a lock cavity configured to house a lock in such a manner that the lock is sandwiched between the second mounting leg and the lip of the ground engaging tool.

DETAILED DESCRIPTION

Figure 1:
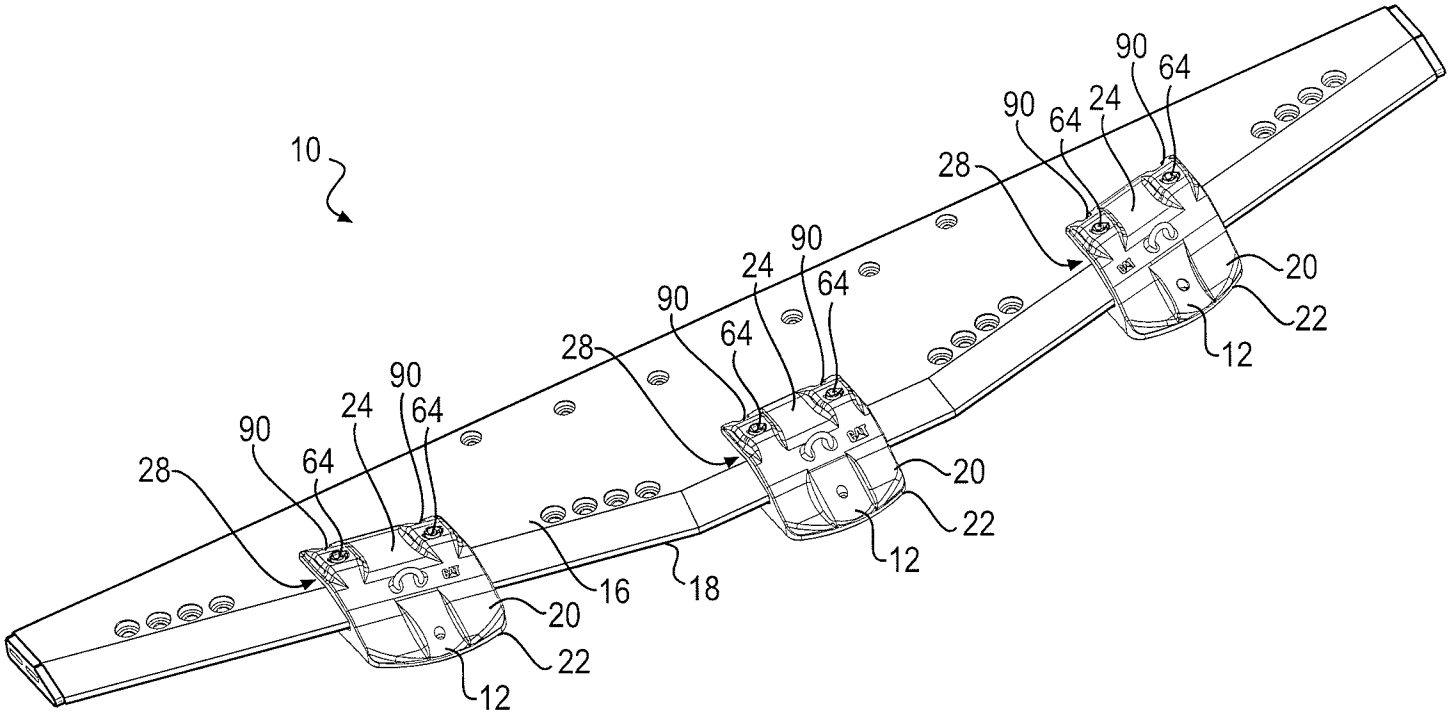
FIG. 1 is a perspective view of one embodiment of a ground engaging tool assembly according to the present disclosure.

FIG. 1 shows a ground engaging tool assembly 10 employing a plurality of edge protectors 12 according to the present disclosure. Ground engaging tool assembly 10 may include a lip 16 that has an edge 18. Lip 16 may be part of any type of ground engaging tool. For example, lip 16 may part of an excavating bucket.

Each edge protector 12 may be configured to mount to lip 16 and shield edge 18 thereof. To that end, each edge protector 12 may include a tip 20 that extends forward from and shields edge 18. As used herein, the term "forward" refers generally to the direction in which edge 18 faces, and the term "rearward" refers generally to the opposite direction. FIGS. 2-4, 8, 9, and 10A-C show one embodiment of a ground engaging tool edge protector 12 in greater detail.

Figure 2:
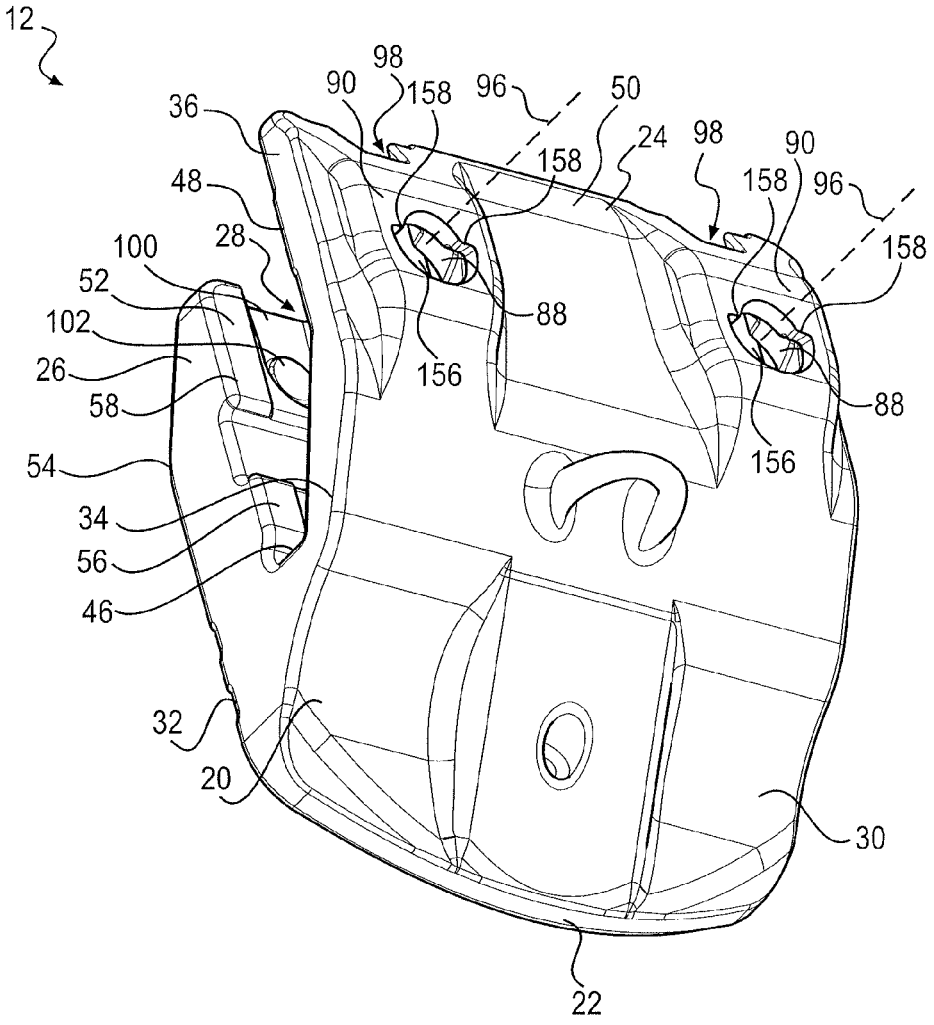
FIG. 2 is a front perspective view of one embodiment of an edge protector according to the present disclosure.
Figure 8:
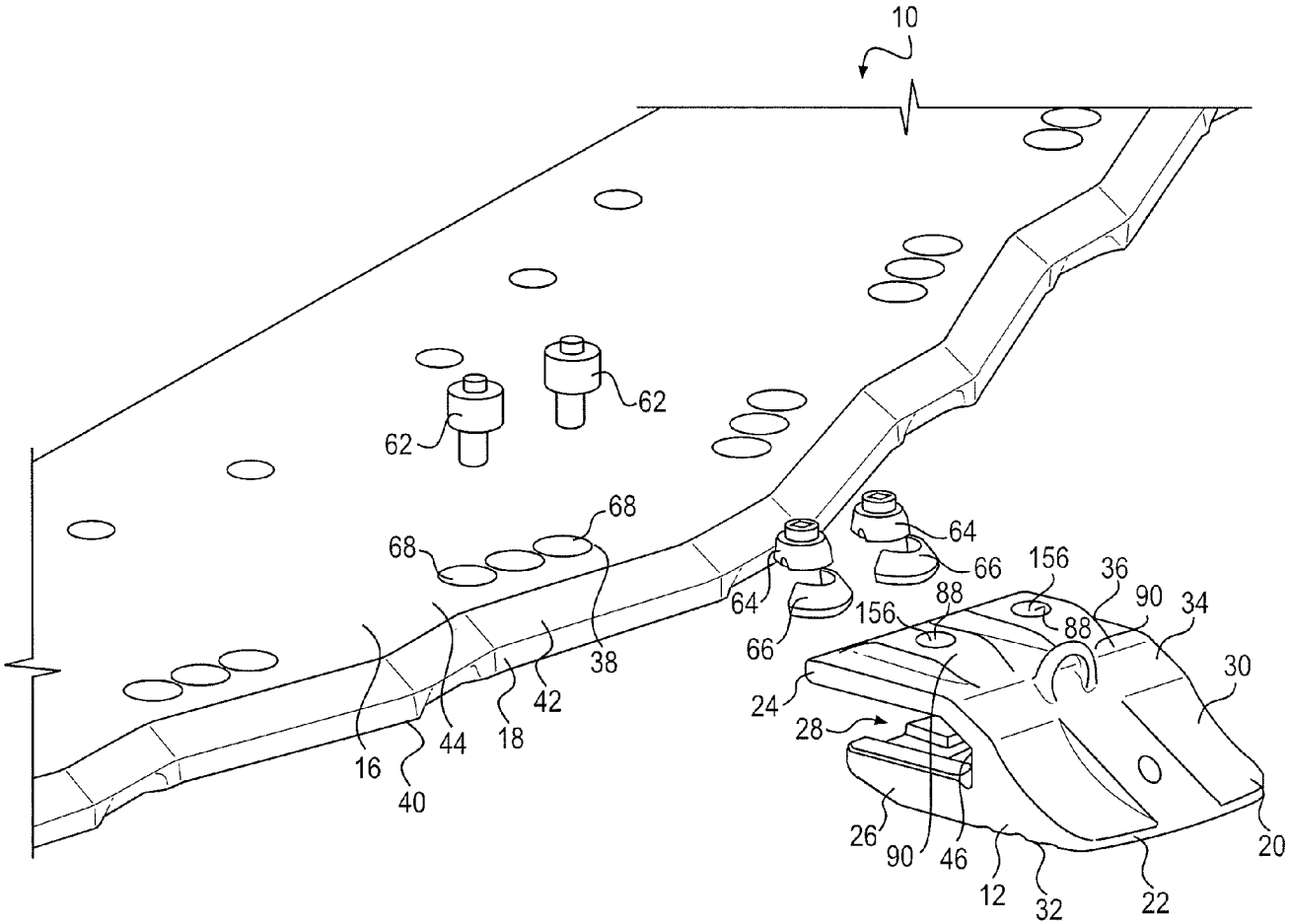
FIG. 8 is an exploded perspective view of one embodiment of a ground engaging tool assembly according to the present disclosure.
Figure 10A:
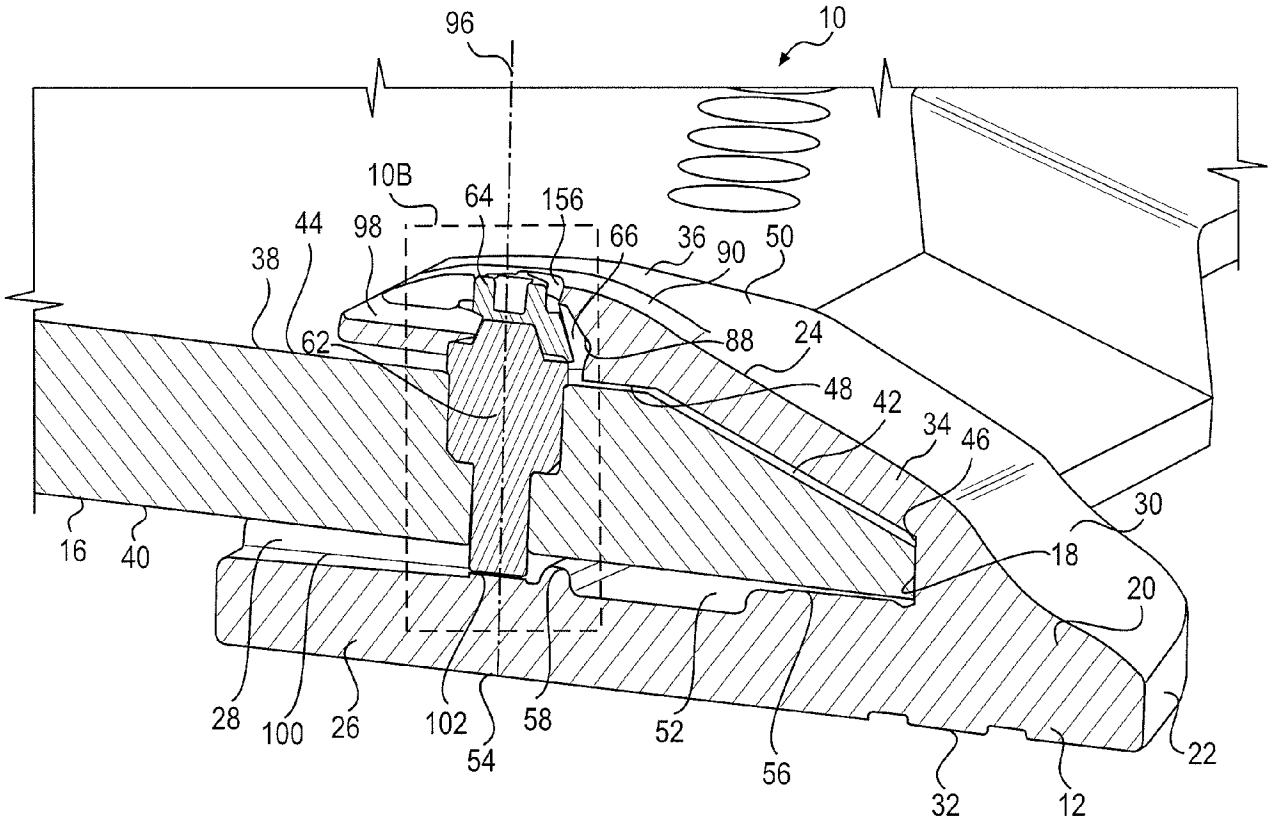
FIG. 10A is a cross-sectional view of one embodiment of an edge protector according to the present disclosure assembled to a lip of a ground-engaging tool, showing one embodiment of retention components used to secure the edge protector to the lip.

The tip 20 of each edge protector 12 may have various shapes. As shown in FIG. 2, in some embodiments, tip 20 may taper as it extends forward. For example, as best shown in FIGS. 8 and 10A, an upper surface 30 of tip 20 may slope downward as it extends forward. In the embodiment shown in the drawings, a lower surface 32 of tip 20 may extend generally straight forward. Alternatively, lower surface 32 may slope upward or downward as it extends forward. At its forward end, tip 20 may have an edge 22 extending across at least a portion of a width of edge protector 12.

Figure 9:
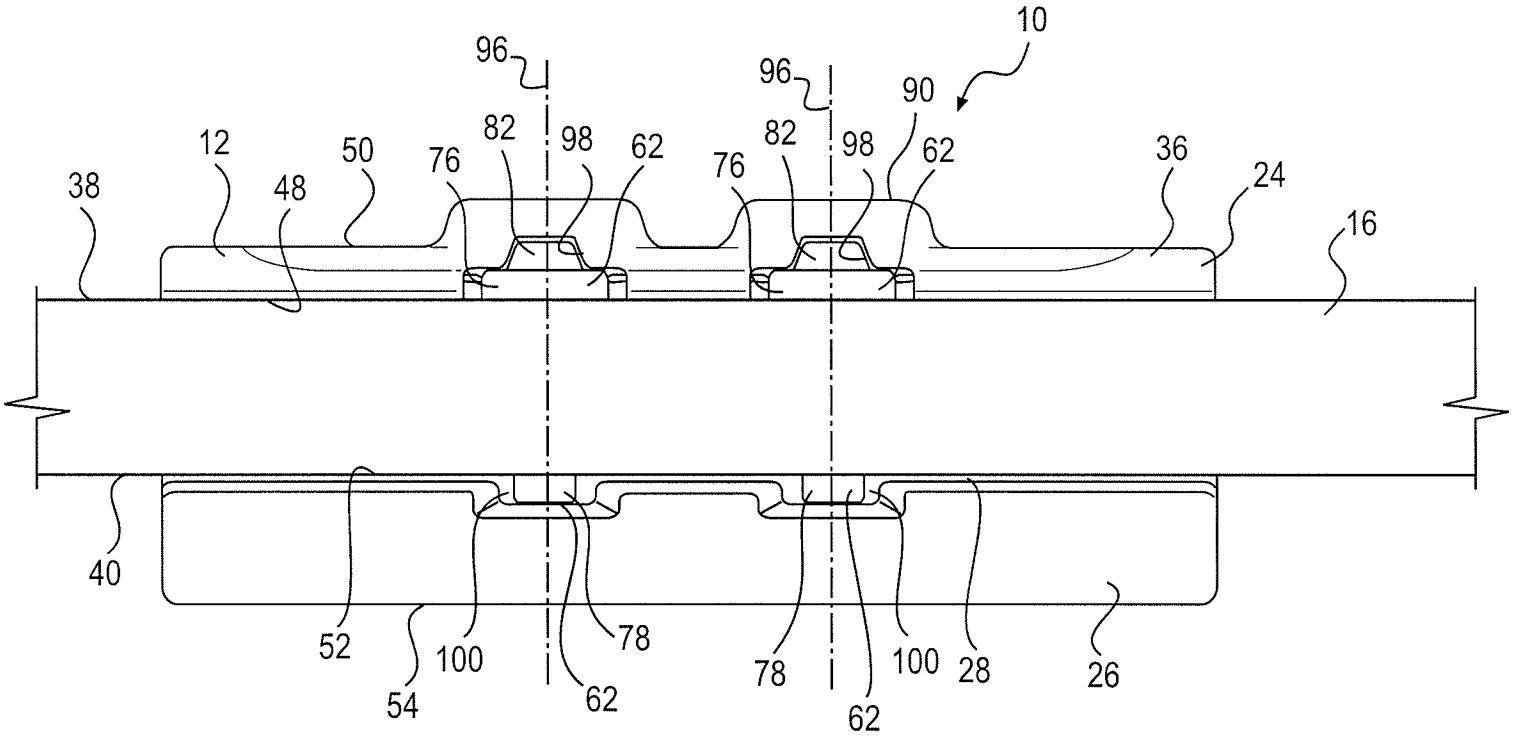
FIG. 9 is a view of one embodiment of a ground engaging tool assembly according to the present disclosure from a rear side.

In addition to tip 20, edge protector 12 may include various other structures. For example, edge protector 12 may include a mounting leg 24 and a mounting leg 26, both extending rearward from tip 20. As best shown in FIGS. 8, 9, and 10A, mounting legs 24, 26 may be spaced from one another by a recess 28 configured to receive a forward end of lip 16, including edge 18. Mounting leg 24 may have an inner surface 48 adjacent recess 28 and an outer surface 50 opposite recess 28. Similarly, mounting leg 26 may have an inner surface 52 adjacent recess 28 and an outer surface 54 opposite recess 28. Adjacent the forward end of recess 28, edge protector 12 may include a wall 46 extending between mounting legs 24, 26. Mounting legs 24, 26 and tip 20 may be engaged to one another in various ways. In some embodiments, mounting legs 24, 26 and tip 20 may be integrally formed with one another, such as by casting or forging them together, or by machining them from one piece of material. Edge protector 12 may be constructed of various materials. In some embodiments, edge protector 12 may be constructed of metal, such as steel or iron.

Figure 3:
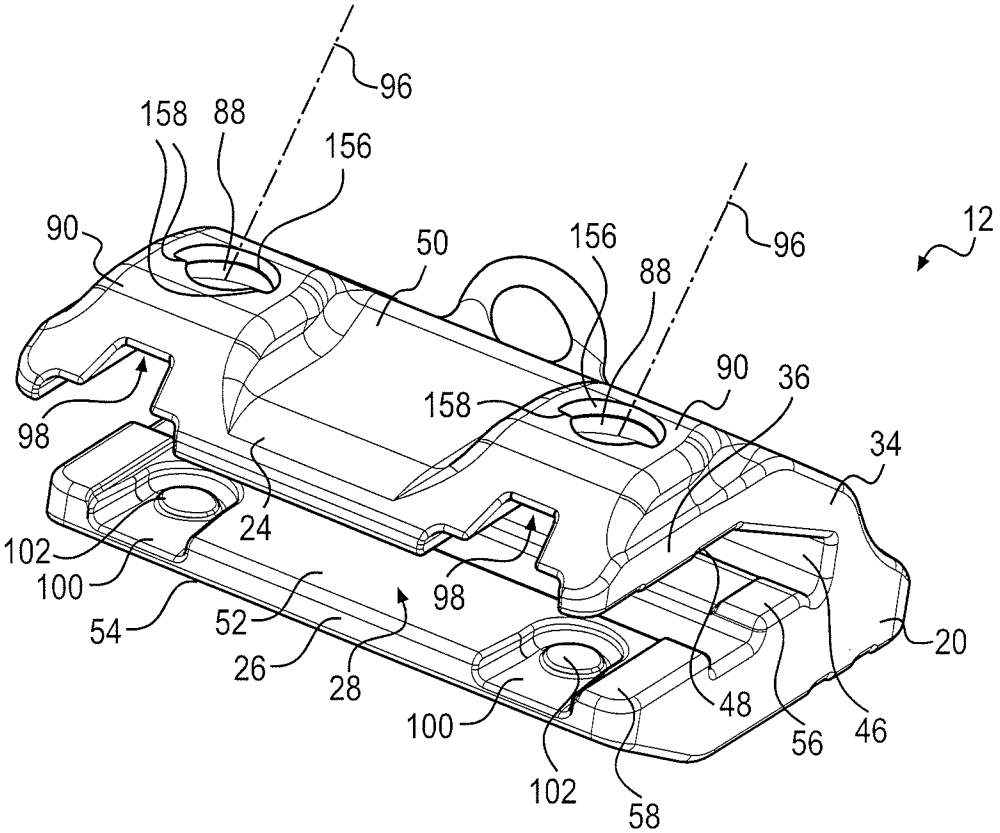
FIG. 3 is a rear perspective view from a top side of the edge protector shown in FIG. 2.
Figure 4:
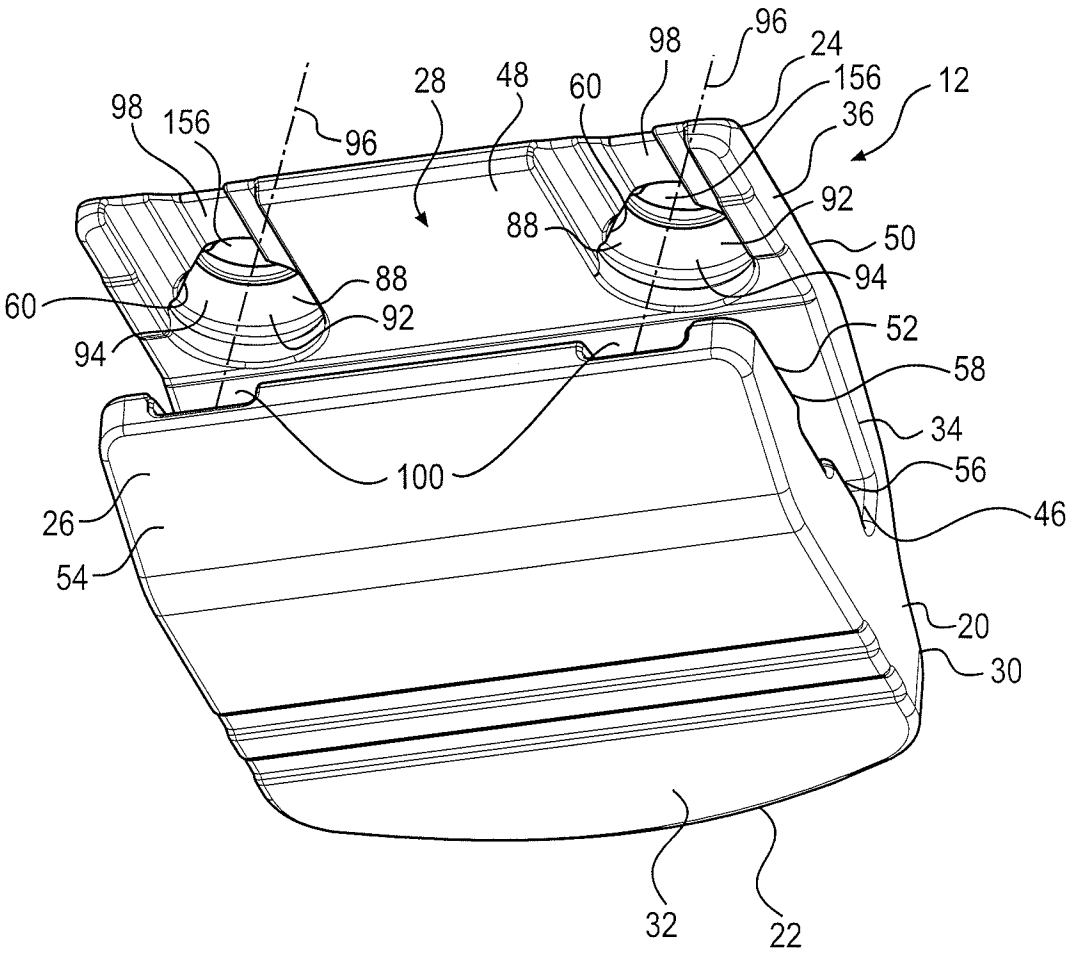
FIG. 4 is a rear perspective view of from a bottom side of the edge protector shown in FIG. 2.

Mounting legs 24, 26 may have various shapes. A mounting leg 24, 26 may either extend generally straight rearward from tip 20, or a mounting leg 24, 26 may have one or more portions that angle upward or downward. As best shown in FIGS. 8, 9, and 10A, some embodiments of edge protector 12 may have mounting leg 26 extending generally straight rearward. Mounting leg 24, on the other hand, may have a front portion 34 that angles upward as it extends rearward from tip 20, and a rear portion 36 that extends generally straight rearward and parallel to mounting leg 26. As best shown in FIGS. 8 and 10A, these shapes of mounting legs 24, 26 may mimic the shapes of an upper surface 38 and a lower surface 40, respectively, of lip 16. Like mounting leg 26, lower surface 40 of lip 16 may extend substantially straight rearward. On the other hand, like mounting leg 24, upper surface 38 may have a forward portion 42 that angles upward as it extends rearward, as well as a rear portion 44 that extends substantially straight rearward. Mounting legs 24, 26 may have various widths, and their widths may or may not vary as they extend rearward from tip 20. As best shown in FIGS. 2-4, in some embodiments, mounting legs 24, 26 may both maintain substantially the same width as a rear end of tip 20 as they extend rearward from tip 20.

Edge protector 12 may have various configurations at the sides of recess 28. As best shown in FIGS. 2-4, in some embodiments, the spaces between mounting legs 24, 26 at the sides of recess 28 may be fully open. As shown in FIG. 1, this may allow lip 16 to extend laterally out from recess 28 when a portion of lip 16 is disposed within recess 28.

Edge protector 12 may have various provisions for transferring forces applied to edge protector 12 to lip 16. As best understood with reference to FIG. 10A, wall 46 at the forward end of recess 28 may serve to transfer rearward forces to edge protector 12 by abutting edge 18 of lip 16. Inner surface 48 of mounting leg 24 may serve to transfer downward forces from edge protector 12 to lip 16 by abutting upper surface 38 of lip 16. Similarly, projections 56, 58 on inner surface 52 of mounting leg 26 may serve to transfer upward forces from edge protector 12 to lip 16 by abutting lower surface 40 of lip 16.

Ground engaging tool assembly 10 may include various provisions for securing edge protector 12 to lip 16. In some embodiments, ground engaging tool assembly 10 may employ pins 62 (shown in FIGS. 5, 8, 9, and 10A-C), locks 64 (shown in FIGS. 7A-7C, 8, and 10A-C), and retainer bushings 66 (shown in FIGS. 6, 8, and 10A-C). Ground engaging tool assembly 10 may have various provisions for engaging these components to lip 16 and edge protector 12.

In some embodiments, lip 16 may include passages 68 in which pins 62 may reside. As best shown in FIG. 10A, passages 68 may extend from upper surface 38 to lower surface 40 of lip 16. Each passage 68 may have a first end 70 and a second end 72 with different cross-sectional sizes. For example, end 72 may have a larger cross-sectional size than end 70. Where ends 70, 72 meet, each passage 68 may have a shoulder 74.

Each pin 62 may be configured to sit within one of passages 68. In some embodiments, each pin 62 may have one end 76 with a larger cross-sectional size than the other end 78. In such embodiments, each pin 62 may have a shoulder 80 between end 76 and end 78. End 76 may have a cross-section that fits within end 70 of passage 68, and end 78 may have a cross-section that fits within end 72 of passage 68. Accordingly pin 62 may sit within passage 68 with the ends 76, 78 disposed within ends 70, 72, respectively, of passage 68 and shoulders 80, 74 abutting one another. In some embodiments, end 76 of pin 62 may be longer than end 70 of passage 68, such that end 76 extends out of end 70 of passage 68. Similarly, end 78 of pin 62 may be longer than end 72 of passage 68, such that end 78 extends out of end 72 of passage 68.

Figure 5:
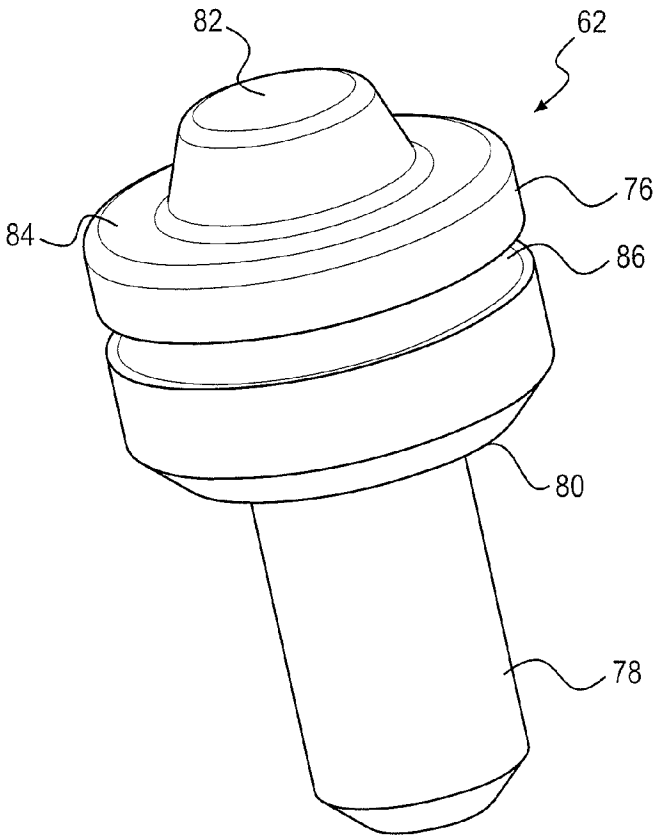
FIG. 5 is a perspective view of one embodiment of a pin according to the present disclosure.

In addition to the foregoing features, each pin 62 may include various other features. As shown in FIG. 5, pin 62 may include a groove 86 extending circumferentially around end 76. Groove 86 may provide a convenient means for removing pin 62 from passage 68 by inserting the end of a prying tool into groove 86 and prying on it. Additionally, the outermost portion of end 76 of pin 68 may include a frustoconical boss 82 for engaging one of locks 64, and an outwardly facing shoulder 84 at the base of boss 82.

Provisions for housing locks 64 may be included in edge protector 12. For example, as best shown in FIGS. 4 and 10A-C, edge protector 12 may include lock cavities 88 for housing locks 64. In some embodiments, lock cavities 88 may be formed in mounting leg 24 adjacent inner surface 48 thereof. As best shown in FIGS. 2 and 10A-C, edge protector 12 may include a lock bulge 90 outward of each lock cavity 88. In the example shown in the figures, lock bulges 90 may extend outward from outer surface 50 of mounting leg 24.

Edge protector 12 may have various numbers and/or arrangements of lock cavities 88 and lock bulges 90. As shown in the figures, in some embodiments, edge protector 12 may include two lock cavities 88 and two lock bulges 90 spaced laterally with respect to one another. Lock cavities 88 and lock bulges 90 may be laterally spaced from one another by approximately the same distance as two of passages 68 in lip 16, such that lock cavities 88 may substantially align with these passages 68 and the pins 62 placed in them.

Figure 10B:
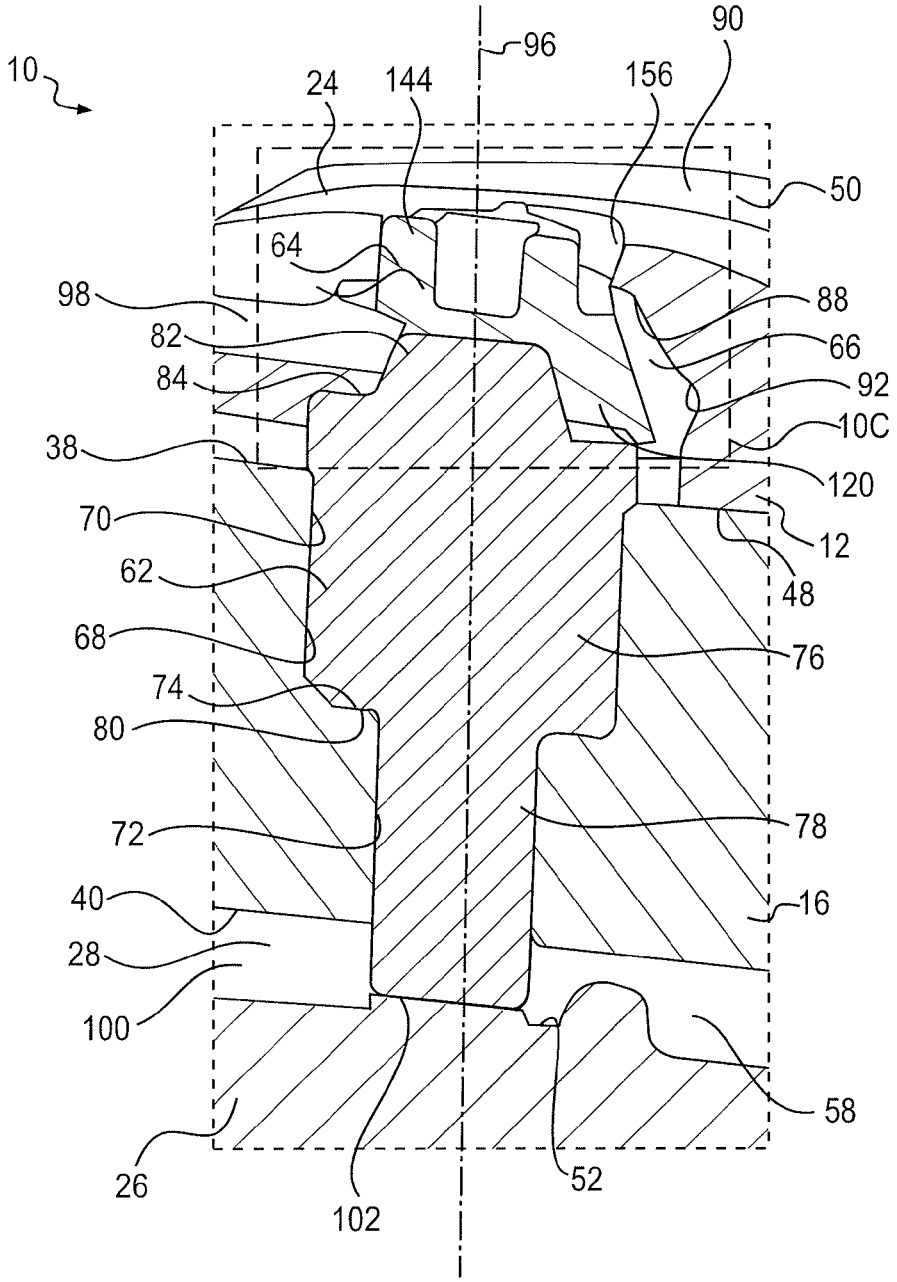
FIG. 10B is an enlarged view of the portion of FIG. 10A contained in rectangle 10B.
Figure 10C:
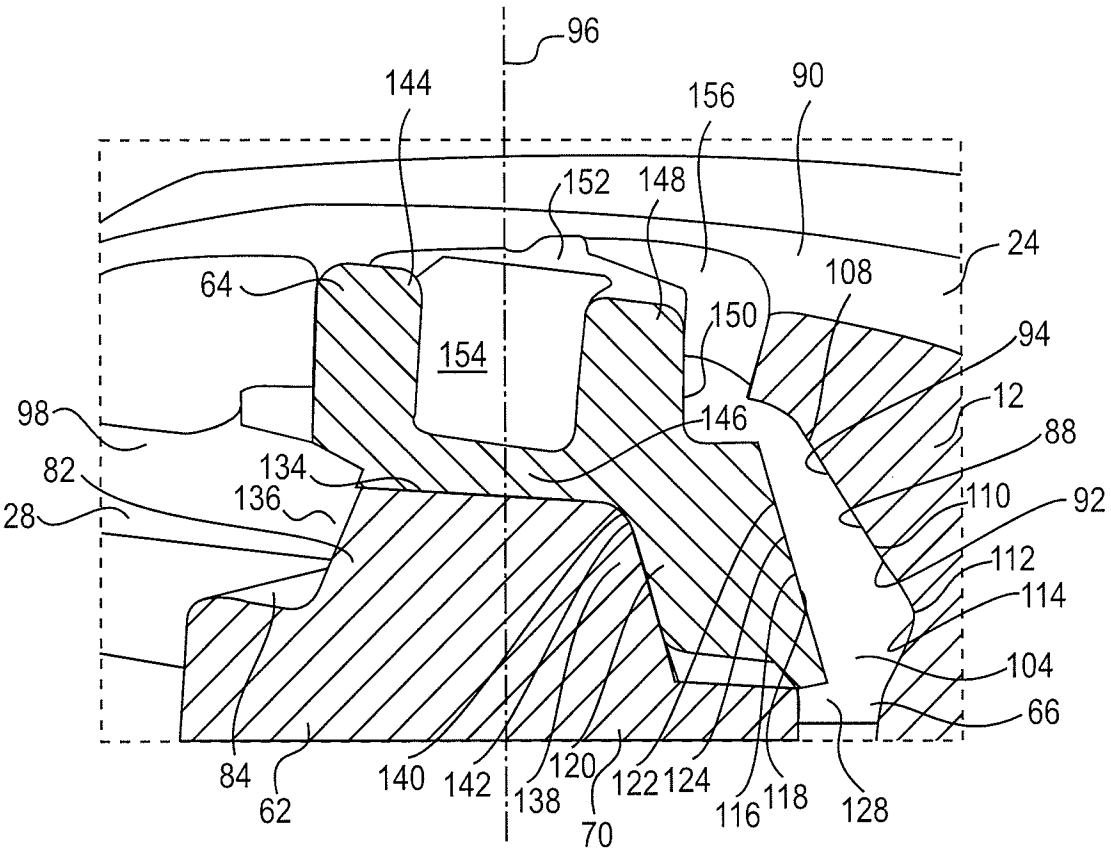
FIG. 10C is an enlarged view of the portion of FIG. 10B contained in rectangle 10C.

Lock cavities 88 may have various configurations. In some embodiments, each lock cavity 88 may be configured to sandwich one of locks 64 between mounting leg 24 and lip 16. For example, as best shown in FIGS. 10B and 10C, lock cavity 88 may include an inner surface 92 that sits on a side of lock 64 opposite lip 16 when lip 16 is disposed in recess 28. Inner surface 92 may have various configurations. In some embodiments, inner surface 92 may include a frustoconical portion 94 that tapers inward as it extends away from recess 28. Frustoconical portion 94 of inner surface 92 may extend circumferentially around and concentric with a lock-rotation axis 96. In some embodiments, frustoconical portion 94 of inner surface 92 may extend only partway around lock-rotation axis 96. For example, as best shown in FIG. 4, frustoconical portion 94 of inner surface 92 may extend around the front and sides, but not the rear, of lock-rotation axis 96. Adjacent the circumferential outer ends of frustoconical portion 94 of inner surface 92, each lock cavity 88 may include radially extending shoulders 60, one of which can be seen for each lock cavity 88 in the view shown in FIG. 4.

On the rear side of lock-rotation axis 96, each lock cavity 88 may open into a slot 98 that extends rearward from the lock cavity 88 along inner surface 48 of mounting leg 24. Each slot 98 may have a cross-section configured to allow passage of some or all of the part of a pin 62 that extends outward of upper surface 38 of lip 16. For example, as best shown in FIG. 9, each slot 98 may have an outer portion configured to allow passage of frustoconical boss 82 of pin 62, and each slot 98 may have a lower portion configured to allow passage of part of pin 62 inward of frustoconical boss 82.

As best shown in FIG. 3, edge protector 12 may have similar slots 100 disposed on inner surface 52 of mounting leg 26. Each slot 100 may have a cross-section configured to allow passage of a portion of each pin 62 projecting outward from lower surface 40 of lip 16. Within a forward end of each slot 100, edge protector 12 may include a boss 102 configured to abut end 78 of pin 62. Each boss 102 may have a size and shape similar to end 78 of pin 62. For example, each boss 102 may have a circular shape with a diameter approximately the same as end 78 of pin 62. Slots 100 may extend substantially parallel to slots 98, and bosses 102 may be substantially aligned with lock-rotation axes 96.

Locks 64 and retainer bushings 66 may have various configurations. In some embodiments, locks 64 and retainer bushings 66 may be configured to seat within inner surfaces 92 of lock cavities 88 in a manner allowing locks 64 to rotate at least partially around lock-rotation axes 96. As best shown in FIGS. 10B and 10C, retainer bushing 66 may seat directly against inner surface 92 of lock cavity 88, and lock 64 may seat against retainer bushing 66.

Figure 6:
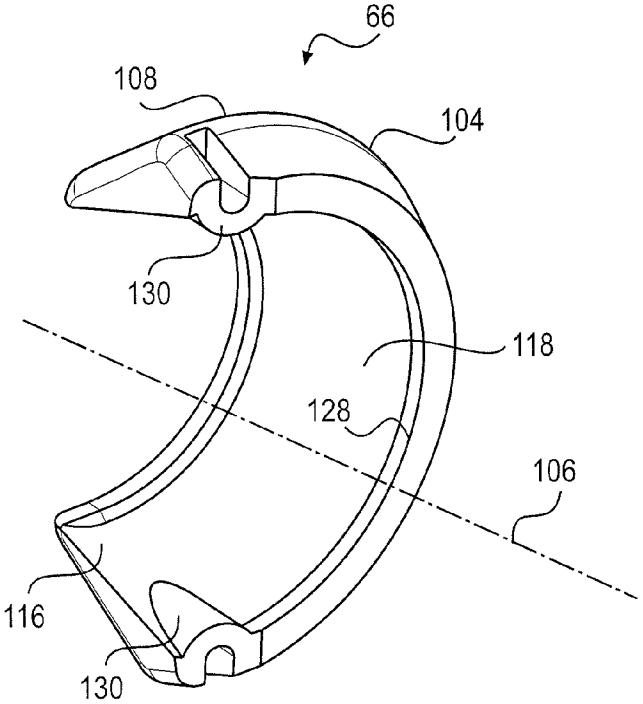
FIG. 6 is a perspective view of one embodiment of a retainer bushing according to the present disclosure.

As best shown in FIG. 6, retainer bushing 66 may include a skirt 104 that extends around a retainer axis 106. Skirt 104 may extend only partway around retainer axis 106. In some embodiments, skirt 104 may extend approximately the same angular amount around retainer axis 106 as inner surface 92 of lock cavity 88 extends around lock-rotation axis 96.

Retainer bushing 66 may be configured to mate with inner surface 92 of lock cavity 88. As shown in FIGS. 8 and 10C, retainer bushing 66 may include an outer surface 108 with a frustoconical portion 110 configured to mate with frustoconical portion 94 of inner surface 92 of lock cavity 88. When retainer bushing 66 is disposed within lock cavity 88 with frustoconical portion 110 of outer surface 108 mated to frustoconical portion 94 of inner surface 92, retainer axis 106 may coincide with lock-rotation axis 96. Retainer bushing 66 and lock cavity 88 may also include provisions for holding retainer bushing 66 within lock cavity 88. For example, as best shown in FIG. 10C, adjacent the lower end of frustoconical portion 110, outer surface 108 of retainer bushing 66 may include a circumferential ridge 112 that mates with a circumferential valley 114 formed in inner surface 92 of lock cavity 88. Retainer bushing 66 and lock cavity 88 may also engage one another in a manner substantially preventing rotation of retainer bushing 66 about lock-rotation axis 96. For example, the radially extending shoulders 60 adjacent the circumferential outer ends of inner surface 92 of lock cavity 88 may abut the circumferential outer ends of skirt 104 of retainer bushing 66.

As best shown in FIGS. 6 and 10C, retainer bushing 66 may include an inner surface 116 opposite outer surface 108. Inner surface 116 may include a frustoconical portion 118 extending circumferentially around and concentric with retainer axis 106. Accordingly, frustoconical portion 118 of inner surface 116 may extend circumferentially around and concentric with lock-rotation axis 96 when retainer bushing 66 is installed in lock cavity 88.

In some embodiments, retainer bushing 66 may include one or more detents for engaging corresponding detents of lock 64. For example, as best shown in FIG. 6, retainer bushing 66 may include detent projections 130 extending radially inward from inner surface 116. Detent projections 130 may have various shapes. In some embodiments, each detent projection 130 may include a convex curved surface, such as a constant-radius surface, jutting radially inward from inner surface 116. Detent projections 130 may be located at various positions on retainer bushing 66. In some embodiments, detent projections 130 may be spaced approximately 180 degrees from one another around retainer axis 106.

Figure 7A:
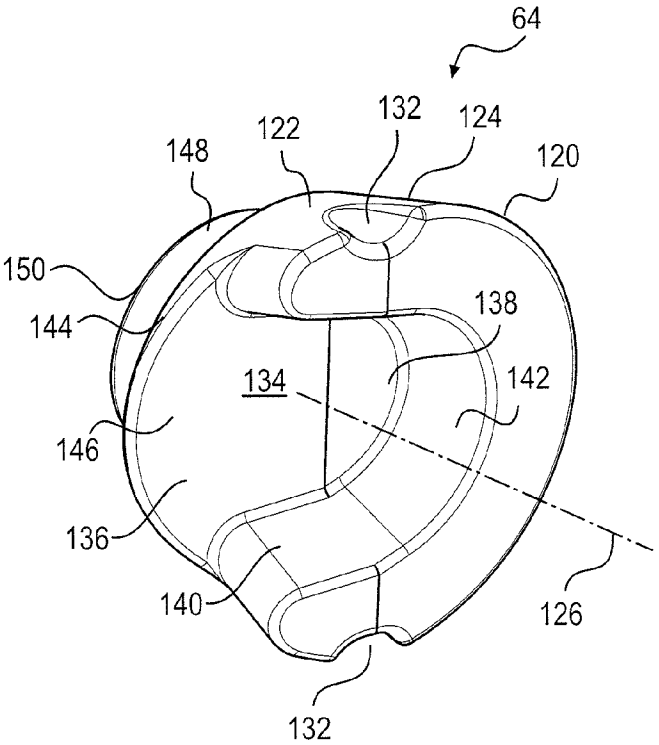
FIGS. 7A-7C are perspective views from different angles of one embodiment of a lock according to the present disclosure.

Lock 64 may be configured to mate with inner surface 116 of retainer bushing 66. For example, as best shown in FIGS. 7A and 10C lock 64 may include a skirt 120 with an outer surface 122 having a frustoconical portion 124 of substantially the same profile as frustoconical portion 118 of inner surface 116 of retainer bushing 66. Frustoconical portion 124 of outer surface 122 may be concentric with and extend circumferentially around a lock axis 126. Skirt 120 and outer surface 122 may extend only partway around lock axis 126. For example, skirt 120 and outer surface 122 may extend around lock axis 126 substantially the same angular amount that skirt 104 of retainer bushing 66 extends around retainer axis 106 and that inner surface 92 of lock cavity 88 extends around lock-rotation axis 96. With skirt 120 and outer surface 122 of lock 64 so configured, lock 64 may be seated within retainer bushing 66 with frustoconical portion 124 of outer surface 122 mated to frustoconical portion 118 of inner surface 116. When lock 64 is so positioned within retainer bushing 66, lock axis 126 may coincide with retainer axis 106 and lock-rotation axis 96.

Lock 64 may have provisions for engaging the detent projections 130 of retainer bushing 66 to releasably hold lock 64 in certain positions about lock-rotation axis 96. For example, as best shown in FIGS. 6 and 7A-7C, lock 64 may include detent recesses 132 extending radially inward from outer surface 122 of skirt 120. Detent recesses 132 may have a shape configured to mate with detent projections 130. In the embodiment shown in the figures, detent recesses 132 may include a concave curved surface, such as a constant-radius curved surface, extending radially inward from frustoconical portion 124 of outer surface 122. In some embodiments, detent recesses 132 may be spaced approximately the same distance from one another as detent projections 130. Thus, where detent projections 130 are spaced approximately 180 degrees from one another, detent recesses 132 may likewise be spaced approximately 180 degrees from one another.

Accordingly, lock 64 may be positioned in retainer bushing 66 with frustoconical portion 124 of outer surface 122 seated against frustoconical portion 118 of inner surface 116 of retainer bushing 66 and detent projections 130 extending into detent recesses 132.

Lock 64 and retainer bushing 66 may be configured to allow one or both of detent recesses 132 and detent projections 130 to deflect to disengage one another. For example, one or both of detent recesses 132 and detent projections 130 may be constructed of a flexible material, including but not limited to a plastic material or an elastomeric material. In some embodiments, retainer bushing 66 may be constructed wholly of such a flexible material.

In some embodiments, lock 64 and/or retainer bushing 66 may include provisions for axially securing lock 64 within retainer bushing 66 and, thus, within lock cavity 88. For example, as best shown in FIGS. 6, 7A, and 10C, retainer bushing 66 may include a lip 128 extending radially inward adjacent an inner end of inner surface 116. Skirt 120 of lock 64 may be sandwiched between frustoconical portion 118 of inner surface 116 and lip 128.

Each lock 64 may also include provisions for receiving at least part of one of pins 62 extending from lip 16. For example, as best shown in FIGS. 7A and 10C, lock 64 may include a lock slot 134 extending into skirt 120. Lock slot 134 may have an open end 136 between outer circumferential ends of skirt 120 and a closed end 138 adjacent a middle portion of skirt 120. In some embodiments, lock slot 134 may have a size and shape such that it can receive frustoconical boss 82 of one of pins 62. This may include skirt 120 having an inner surface 140 with a frustoconical portion 142 disposed adjacent closed end 138 of lock slot 134 and configured to mate with frustoconical boss 82.

Figure 7C:
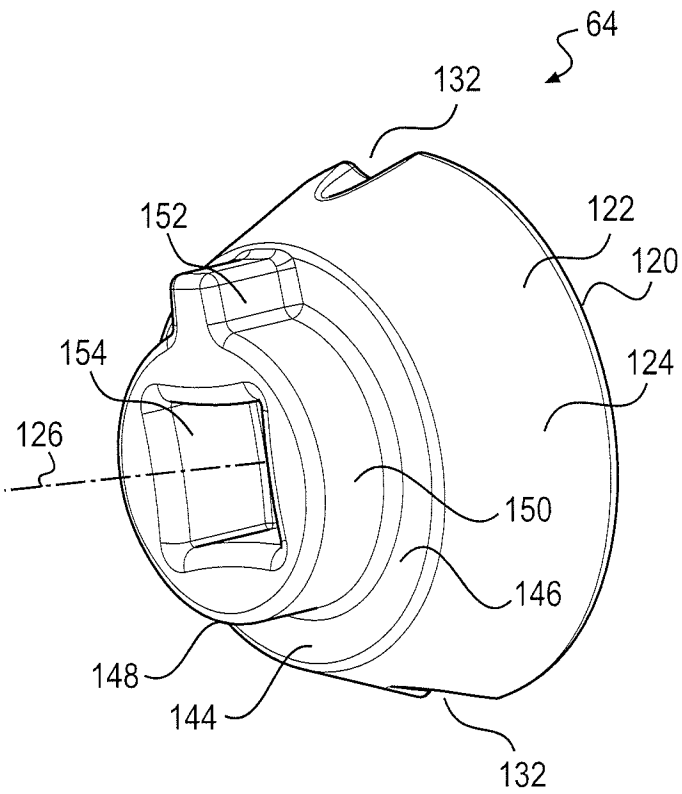
Figure 7B:
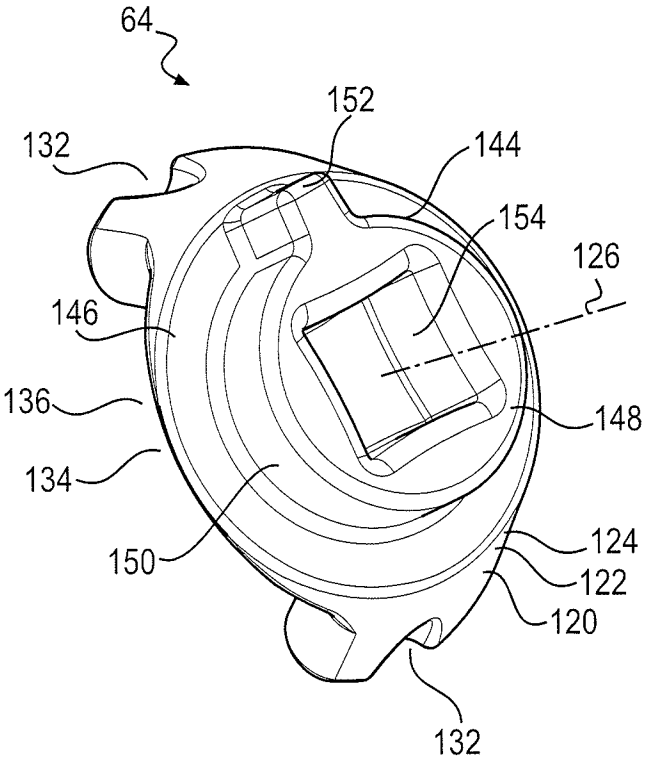

As best shown in FIGS. 7A-7C, in addition to skirt 120 and lock slot 134, lock 64 may include a head 144. Head 144 may attach to skirt 120 adjacent the narrow end of frustoconical portion 124 of outer surface 122 of skirt 120. As best shown in FIG. 7A, head 144 may include a wall 146 extending across the narrow end of skirt 120 adjacent one side of lock slot 134. In some embodiments, wall 146 may fully enclose the side of lock slot 134 adjacent the narrow end of skirt 120. As best shown in FIGS. 7B and 7C, the side of head 144 opposite lock slot 134 may include a projection 148 extending from wall 146 away from skirt 120 along lock axis 126. Projection 148 may include a substantially cylindrically shaped outer surface 150 extending around most of lock axis 126 and a tab 152 extending radially outward relative to lock axis 126. In some embodiments, tab 126 may extend transverse relative to the direction that lock slot 134 extends from its open end 136 to its closed end 138.

As noted above, lock 64 may be installed in retainer bushing 66 and lock cavity 88 with frustoconical portion 124 of outer surface 122 of lock 64 mated to frustoconical portion 118 of inner surface 116 of retainer bushing 66 and detent recesses 132 of lock 64 mated to detent projections 130 of retainer bushing 66. When lock 64 is disposed in this position, open end 136 of lock slot 134 may face rearward and align with slot 98 on inner surface 48 of mounting leg 24. This state may allow freely sliding a portion of a pin 62, such as frustoconical boss 82, into or out of lock slot 134 through open end 136 and slot 98. This may allow freely sliding edge protector 12 onto or off of lip 16. Accordingly, this position of lock 64 may be considered an unlocked position.

Lock 64 may also have a locked position where lock 64 is rotated around lock-rotation axis 96 to a position where closed end 138 of lock slot 134 is disposed adjacent slot 98 at the rear side of lock cavity 88. In this state, the portion of lock skirt 120 adjacent closed end 138 may preclude sliding frustoconical boss 82 of pin 62 into or out of lock slot 134. This may prevent freely sliding edge protector 12 onto or off of lip 16. The locked position of lock 64 may be approximately 180 degrees from the unlocked position about lock-rotation axis 96. In the locked position, as in the unlocked position, detent recesses 132 of lock 64 may engage detent projections 130 of retainer bushing 66, which may releasably hold lock 64 in the locked position.

To rotate lock 64 between the unlocked position and the locked position, sufficient torque may be applied to lock 64 about lock-rotation axis 96 to cause detent projections 130 and/or detent recesses 132 to deflect and disengage from one another. Once the detents disengage one another, frustoconical portion 124 of outer surface 122 of lock skirt 120 may slide along frustoconical portion 118 of inner surface 116 of retainer bushing 66, as lock 64 rotates around lock-rotation axis 96. Once lock 64 rotates approximately 180 degrees around lock-rotation axis 96, detent projections 130 and detent recesses 132 may reengage one another to releasably hold lock 64 in that rotational position.

Ground engaging tool assembly 10 may include various provisions for rotating lock 64 about lock-rotation axis 96. As best shown in FIGS. 7A-7C, lock 64 may include a tool interface 154 in lock head 144 for rotating lock 64 about lock axis 126 and thus, lock-rotation axis 96. Tool interface 154 may include any type of features configured to be engaged by a tool to apply torque to lock 64 about lock axis 126 and lock-rotation axis 96. For example, as shown in the figures, tool interface 154 may include a recess with a cross-section configured to engage a square drive tool.

As best shown in FIGS. 2-4, 8, and 10A-10C, edge protector 12 may include a tool opening 156 associated with each lock cavity 88 to provide access to tool interface 154 of lock 64. Each tool opening 156 may extend from outer surface 50 of mounting leg 24, through one of lock bulges 90, to a lock cavity 88. As best shown in FIGS. 10A-C, when each lock 64 is seated within a lock cavity 88, head 144 of lock 64 may extend at least partially through the associated tool opening 156 toward outer surface 50.

Each tool opening 156 may have various shapes. As best shown in FIG. 2, in some embodiments, each tool opening 156 may include a pair of shoulders 158 spaced approximately 180 degrees from one another about lock-rotation axis 96. Shoulders 158 may be positioned within the rotational path of tab 152 of lock 64 to limit rotation of lock 64 to approximately 180 degrees about lock-rotation axis 96.

Ground engaging tool assembly 10, edge protector 12, and the various other components discussed above are not limited to the configurations shown in the figures. For example, edge protector 12 may include a different number of lock cavities 88, and the assembly 10 may employ a different number of pins 62, locks 64, and retainer bushings 66. Additionally, in lieu of pins 62, ground engaging tool assembly 10 may employ projections integrally affixed to lip 16. Furthermore, edge protector 12, lock cavities 88, locks 64, and retainer bushings 66 may have different configurations than those shown in the figures and discussed above.

Industrial Applicability

Ground engaging tool assembly 10 and edge protector 12 may have use for various excavating and similar tasks. When assembled to lip 16, edge protector 12 may protect edge 18 of lip 16 from impact with soil, rock, and other substances encountered in such tasks. This may prolong the life of lip 16 and edge 18 thereof.

The disclosed configurations of ground engaging tool assembly 10 may allow readily attaching edge protector 12 to lip 16 and removing edge protector 12 from lip 16 for service and/or replacement. In preparation to attach edge protector 12 to lip 16, pins 62 may be inserted into passages 68 in lip 16 with ends 76 of pins 62 protruding from upper surface 38 of lip 16 and ends 78 protruding from lower surface 40 of lip 16. Additionally, retainer bushings 66 and locks 64 may be installed into lock cavities 88 with locks 64 in their unlocked position. As discussed above, with locks 64 in their unlocked position, open ends 136 of lock slots 134 may face rearward so that they register with slots 98 in mounting leg 24.

With pins 62 installed in lip 16 and locks 64 in their unlocked positions, edge protector 12 may be slid rearward to slide lip 16 into recess 28 between mounting legs 24, 26. This may involve sliding ends 78 of pins 62 through slots 100 in mounting leg 26. When pins 62 are fully inserted into slots 100, ends 78 of pins 62 may rest on bosses 102 at the forward ends of slots 100. Simultaneously, frustoconical bosses 82 of opposite ends 76 of pins 62 may slide through slots 98 into lock slots 134. FIGS. 10A-10C illustrate edge protector 12 slid onto lip 16 with frustoconical bosses 82 of pins 62 disposed in slots 134 of locks 64 and locks positioned in the unlocked position.

From this state, edge protector 12 may be releasably secured to lip 16 by rotating locks 64 about lock rotation axis 96 to rotate closed end 138 of lock slot 134 behind frustoconical boss 82 of pin 62, capturing pin 62 in lock 64 and lock cavity 88, preventing edge protector from sliding forward off of lip 16. Edge protector 12 may be removed from lip 16 by rotating locks 64 back to their unlocked positions shown in FIGS. 10A-10C and sliding edge protector 12 forward off of lip 16.

When edge protector 12 is installed to lip 16, the retaining hardware of ground engaging tool assembly 10 may be securely captured by mounting legs 24, 26 and lip 16. For example, locks 64 may be sandwiched between inner surfaces 92 of lock cavities 88 of mounting leg 24 and upper surface 38 of lip 16. This may help ensure that locks 64 do not work loose and become lost. The inclusion of lock bulges 90 on edge protector 12 may facilitate capturing locks 64 between mounting leg 24 and lip 16. Additionally, in some embodiments, pins 62, locks 64, and retainer bushings 66 may be constructed with lengths such that their collective length when assembled is approximately the same as the distance between each boss 102 in slot 100 of mounting leg 26 and the inner surface 92 of lock cavity 88. As a result, pins 62, locks 64, and retainer bushing 66 may be snugly retained between mounting legs 24 and 26. This may help ensure that these components remain in place and hold edge protector 12 to lip 16, even as lip 16 and edge protector 12 wear.

Other embodiments of the disclosed systems will be apparent to those skilled in the art from consideration of the specification and practice of the systems disclosed herein. It is intended that the specification and examples be considered as exemplary only, with a true scope of the disclosure being indicated by the following claims and their equivalents.

What is claimed is:

1. An edge protector for mounting to a lip of a ground engaging tool and shielding an edge of the lip, the edge protector comprising:

a tip configured to extend forward from the edge of the lip of the ground engaging tool;

a first mounting leg extending rearward from the tip; and a second mounting leg extending rearward from the tip and spaced from the first mounting leg by a recess configured to receive the lip of the ground engaging tool between the first mounting leg and the second mounting leg; and wherein the first mounting leg includes:

a first lock cavity configured to house a first lock in such a manner that the first lock is sandwiched between the first mounting leg and the lip of the ground engaging tool; and a second lock cavity laterally spaced from the first lock cavity and configured to house a second lock in such a manner that the second lock is sandwiched between the first mounting leg and the lip of the ground engaging tool, wherein the first mounting leg includes a slot extending from the first lock activity rearward along an inner surface of the first mounting leg, and wherein the ,second . mounting leg includes a slot extending along an inner surface of the second mounting leg.

2. The edge protector of claim 1, wherein the first lock cavity includes a frustoconical surface for sandwiching the lock between the first mounting leg and the lip of the ground engaging tool, the frustoconical surface tapering inward as it extends away from the recess toward an outer surface of the first mounting leg.

3. The edge protector of claim 2, wherein the frustoconical surface extends around a lock-rotation axis extending substantially transverse to the rearward direction in which the first mounting leg extends.

4. The edge protector of claim 1, wherein the first mounting leg includes a tool opening extending from the outer surface of the first mounting leg to the first lock cavity.

5. The edge protector of claim 1, wherein the first mounting leg includes a first tool opening extending from the outer surface of the first mounting leg to the first lock cavity and a second tool opening extending from the outer surface of the first mounting leg to the second lock cavity.

6. An edge protector for mounting to a lip of a ground engaging tool and shielding an edge of the lip, the edge protector comprising:

a tip configured to extend forward from the edge;

a first mounting leg extending rearward from the tip, the first mounting leg including:

a lock bulge extending outward from an outer surface of the first mounting leg, a lock cavity configured to receive a lock inward of the lock bulge, and a first slot extending from the lock cavity rearward along an inner surface of he first mounting leg;

a second mounting leg extending rearward from the tip and spaced from the first mounting leg by a recess, the second mounting leg including:

a second slot extending along an inner surface of the second mounting leg, wherein the first slot is configured to allow passage of a portion of a pin projecting from an upper surface of the lip of the ground engaging tool, wherein the second slot is aligned with the first slot and is configured to allow passage of another portion of the pin projecting from a lower surface of the lip of the ground engaging tool, and wherein the first slot includes a first portion configured to allow passage of a first portion of the pin and a second portion configured to allow passage of a second portion of the pin, the second portion being wider than the first portion.

7. The edge protector of claim 6, wherein:

opposing sides of the recess are open, and the recess is configured to receive the lip of the ground engaging tool between the first mounting leg and the second mounting leg and allow the lip to extend laterally out from the recess through the open sides.

8. The edge protector of claim 6, wherein the second slot includes a boss configured to abut an end of the pin.

9. The edge protector of claim 8, wherein the first mounting leg further includes a tool opening extending from the outer surface of the first mounting leg to the lock cavity.

10. The edge protector of claim 6, wherein the first slot extends from an inner surface of the first mounting leg into the lock bulge.

11. The edge protector of claim 6, wherein the lock cavity includes a frustoconical surface that tapers inward as it extends toward the outer surface of the first mounting leg.

12. A ground engaging tool assembly, comprising:

a lip of a ground engaging tool, the lip having an edge;

an edge protector mounted to the Hp, the edge protector including:

a tip extending forward from the edge, a first mounting leg extending rearward from the tip adjacent a first side of the lip, and a second mounting leg extending rearward from the tip and spaced from the first mounting leg by a recess configured to receive the lip of the ground engaging tool between the first mounting leg and the second mounting leg, wherein the first mounting leg includes:

a first lock cavity configured to house a lock in such a manner that the lock is sandwiched between the first mounting leg and the lip of the ground engaging tool, wherein the first lock cavity includes a frustoconical surface for sandwiching the lock between the first mounting leg and the lip of the ground engaging tool, the frustoconical surface tapering inward as it extends away from the recess toward an outer surface of the first mounting leg, and a second lock cavity laterally spaced from the first lock cavity and configured to house a second lock in such a manner that the second lock is sandwiched between the first mounting leg and the lip of the ground engaging tool, wherein the first mounting leg includes a slot extending the first lock cavity rearward along an inner surface of the first mounting leg, and the second mounting leg includes a slot extending along an inner surface of the second mounting leg.

13. The ground engaging tool assembly of claim 12, wherein the frustoconical surface extends around a lock-rotation axis extending substantially transverse to the rearward direction in which the first mounting leg extends.

14. The ground engaging tool assembly of claim 12, wherein the first mounting leg includes a tool opening extending from the outer surface of the first mounting leg to the first lock cavity.

* * * * *

UNITED STATES PATENT AND TRADEMARK OFFICE

CERTIFICATE OF CORRECTION

PATENT NO. : 8,959,807 B2
APPLICATION NO. : 13/706681
DATED : February 24, 2015
INVENTOR(S) : LaHood et al.

It is certified that error appears in the above-identified patent and that said Letters Patent is hereby corrected as shown below:

IN THE SPECIFICATION

Column 8, line 59, delete "Industrial Applicability" and insert -- INDUSTRIAL APPLICABILITY --.

IN THE CLAIMS

Column 10, line 11, in Claim 1, delete "activity" and insert -- cavity --.

Column 10, line 13, in Claim 1, delete ",second ." and insert -- second --.

Column 10, line 44, in Claim 6, delete "he" and insert -- the --.

Column 11, line 14, in Claim 12, delete "Hp," and insert -- lip, --.

Column 12, line 14 (Approx.), in Claim 12, delete "extending the" and insert -- extending from the, --.

Signed and Sealed this
Twenty-second Day of December, 2015

Michelle K. Lee

Michelle K. Lee
*Director of the United States Patent and Trademark Office*